US011078048B2

(12) United States Patent
Grainger et al.

(10) Patent No.: US 11,078,048 B2
(45) Date of Patent: Aug. 3, 2021

(54) ELEVATOR SHEAVE CLEANER

(71) Applicant: OTIS ELEVATOR COMPANY, Farmington, CT (US)

(72) Inventors: Ethan Kent Grainger, Florence, SC (US); James O'Neal Creel, Jr., Hemingway, SC (US); Ronnie D. Forrest, Jr., Florence, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 396 days.

(21) Appl. No.: 16/260,627

(22) Filed: Jan. 29, 2019

(65) Prior Publication Data

US 2020/0239281 A1 Jul. 30, 2020

(51) Int. Cl.
*B66B 7/12* (2006.01)

(52) U.S. Cl.
CPC ..... *B66B 7/1276* (2013.01)

(58) Field of Classification Search
CPC ..... B66B 7/1276; B66B 15/04; B66B 7/1292; B66B 7/12; B65G 45/16; B65G 45/12
See application file for complete search history.

(56) References Cited

U.S. PATENT DOCUMENTS

| | | | | |
|---|---|---|---|---|
| 4,172,509 | A | 10/1979 | Miyagi et al. | |
| 7,478,705 | B2 | 1/2009 | Schaffhauser et al. | |
| 7,665,179 | B2 | 2/2010 | Connolly | |
| 8,545,135 | B2 | 10/2013 | Wilson, Jr. et al. | |
| 8,955,649 | B2 * | 2/2015 | Yokobayashi | B66B 7/1292 187/414 |
| 2004/0134757 | A1 * | 7/2004 | DeVries | B65G 45/16 198/497 |
| 2005/0217058 | A1 * | 10/2005 | Connolly | B08B 1/008 15/256.6 |
| 2007/0044267 | A1 * | 3/2007 | Connolly | B66B 7/1284 15/256.6 |

FOREIGN PATENT DOCUMENTS

| | | |
|---|---|---|
| CA | 2115956 | 8/1995 |
| CN | 202296704 | 7/2012 |
| CN | 203333120 | 12/2013 |
| CN | 203486705 | 3/2014 |
| CN | 204150883 | 2/2015 |
| CN | 102971093 | 6/2015 |
| CN | 103449280 | 6/2016 |

(Continued)

OTHER PUBLICATIONS

US 8,336,426 B2, 12/2012, Wilson, Jr. et al. (withdrawn)
Extended European Search Report for Application No. EP 19 21 9660 dated Aug. 28, 2020.

*Primary Examiner* — Jeffrey Donels
(74) *Attorney, Agent, or Firm* — Carlson, Gaskey & Olds

(57) ABSTRACT

An illustrative example elevator sheave cleaner includes a base configured to be situated on a first side of load bearing members that wrap at least partially around a sheave. A plurality of fingers extend from the base and are configured to be received between adjacent load bearing members. A plurality of cleaning pads are respectively supported by the fingers and spaced from the base. The cleaning pads are configured to contact and clean a surface of the sheave when the cleaning pads are on a second, opposite side of the load bearing members.

20 Claims, 5 Drawing Sheets

(56) References Cited

FOREIGN PATENT DOCUMENTS

| | | | |
|---|---|---|---|
| CN | 205367402 | | 7/2016 |
| CN | 106629352 | | 5/2017 |
| CN | 206529190 | | 9/2017 |
| CN | 107522066 | | 12/2017 |
| CN | 107673163 | | 2/2018 |
| CN | 207072731 | | 3/2018 |
| CN | 108015712 | A | 5/2018 |
| CN | 108557613 | | 9/2018 |
| CN | 207861661 | | 9/2018 |
| CN | 108750872 | | 11/2018 |
| CN | 108861919 | | 11/2018 |
| CN | 108996367 | | 12/2018 |
| CN | 109264540 | | 1/2019 |
| CN | 208561365 | | 3/2019 |
| CN | 208684193 | | 4/2019 |
| CN | 208716633 | | 4/2019 |
| CN | 107792750 | | 5/2019 |
| EP | 1880968 | | 1/2011 |
| JP | S61130578 | U | 8/1986 |
| JP | H02135588 | U | 11/1990 |
| JP | H09165165 | | 6/1997 |
| JP | 2003054854 | | 2/2003 |
| JP | 2003054854 | A | 2/2003 |
| JP | 2009274809 | | 11/2009 |
| JP | 2010037032 | | 2/2010 |
| JP | 2011037606 | A | 2/2011 |
| JP | 5271195 | | 5/2013 |
| JP | 5772215 | | 7/2015 |
| JP | 2018188283 | A | 11/2018 |
| WO | 2019038808 | | 2/2019 |

* cited by examiner

ELEVATOR SHEAVE CLEANER

BACKGROUND

Traction-based elevator systems include a machine and sheaves for moving a roping assembly to cause desired movement of the elevator car. The machine typically controls rotation of a traction sheave. Other sheaves are referred to as idler sheaves because they passively rotate in response to movement of the roping assembly.

Maintaining proper traction between the traction sheave and the roping assembly requires proper material selection for the surface of the drive sheave based on the type of roping, such as round steel ropes or coated flat belts. In addition to using the right materials, it is necessary to ensure that the sheave surface is free of contaminants that would interfere with the desired traction. Cleaning elevator sheaves has traditionally been done manually by a mechanic who holds a cloth against the sheave surface to wipe it clean. While various sheave cleaner devices have been proposed they are not without drawbacks, such as being difficult to place in position.

SUMMARY

An illustrative example elevator sheave cleaner includes a base configured to be situated on a first side of load bearing members that wrap at least partially around a sheave. A plurality of fingers extend from the base and are configured to be received between adjacent load bearing members. A plurality of cleaning pads are respectively supported by the fingers and spaced from the base. The cleaning pads are configured to contact and clean a surface of the sheave when the cleaning pads are on a second, opposite side of the load bearing members.

In an example embodiment having one or more features of the elevator sheave cleaner of the previous paragraph, the fingers include a first portion oriented secured to the base and a second portion oriented at an oblique angle relative to the first portion and the cleaning pads are supported on the second portions.

In an example embodiment having one or more features of the elevator sheave cleaner of either of the previous paragraphs, the base has a length, the base is configured to have the length oriented parallel with an axis of rotation of the sheave, and the cleaning pads are oriented at an oblique angle relative to the axis of rotation when the cleaning pads contact the surface of the sheave.

In an example embodiment having one or more features of the elevator sheave cleaner of any of the previous paragraphs, each cleaning pad comprises a rigid pad support and a flexible pad and each rigid pad support is secured to the second portion of the finger supporting the cleaning pad.

In an example embodiment having one or more features of the elevator sheave cleaner of any of the previous paragraphs, each flexible pad comprises a sponge.

In an example embodiment having one or more features of the elevator sheave cleaner of any of the previous paragraphs, the fingers comprise a first material, the rigid pad supports comprise a second material, and the first material is different than the second material.

In an example embodiment having one or more features of the elevator sheave cleaner of any of the previous paragraphs, at least some of the cleaning pads are oriented at the oblique angle in a first direction, at least one of the cleaning pads is oriented at the oblique angle in a second direction, and the first direction is different than the second direction.

In an example embodiment having one or more features of the elevator sheave cleaner of any of the previous paragraphs, the base comprises a first portion configured to be secured in a selected position near the sheave and a second portion that supports the fingers.

In an example embodiment having one or more features of the elevator sheave cleaner of any of the previous paragraphs, the first portion of the base includes a plurality of slots that are each configured to receive at least a portion of a mounting member associated with an elevator machine frame.

In an example embodiment having one or more features of the elevator sheave cleaner of any of the previous paragraphs, the fingers comprise a flat surface parallel with a cleaning surface on the cleaning pads and a rib transverse to the flat surface.

An example embodiment having one or more features of the elevator sheave cleaner of any of the previous paragraphs includes a plurality of fasteners that secure the fingers to the base such that the fingers are selectively removable from the base.

An illustrative example elevator sheave cleaner includes a base configured to be situated near a sheave. A plurality of fingers extend from the base and include a first portion oriented generally perpendicular to the base and a second portion oriented at an oblique angle relative to the first portion. A plurality of cleaning pads are respectively supported by the second portion of one of the fingers.

In an example embodiment having one or more features of the elevator sheave cleaner of any of the previous paragraphs, the fingers are configured to be received between adjacent load bearing members that at least partially wrap around the sheave.

In an example embodiment having one or more features of the elevator sheave cleaner of any of the previous paragraphs, the base is configured to be received on a first side of the load bearing members when the base is situated near the sheave and the cleaning pads are received against a surface of the sheave on a second, opposite side of the load bearing members.

In an example embodiment having one or more features of the elevator sheave cleaner of any of the previous paragraphs, each cleaning pad comprises a rigid pad support and a flexible pad. Each rigid pad support is secured to the second portion of the finger supporting the cleaning pad.

In an example embodiment having one or more features of the elevator sheave cleaner of any of the previous paragraphs, each flexible pad comprises a sponge.

In an example embodiment having one or more features of the elevator sheave cleaner of any of the previous paragraphs, the fingers comprise a first material, the rigid pad supports comprise a second material, and the first material is different than the second material.

In an example embodiment having one or more features of the elevator sheave cleaner of any of the previous paragraphs, at least some of the cleaning pads are oriented at the oblique angle in a first direction, at least one of the cleaning pads is oriented at the oblique angle in a second direction and the first direction is different than the second direction.

In an example embodiment having one or more features of the elevator sheave cleaner of any of the previous paragraphs, the fingers comprise a flat surface parallel with a cleaning surface on the cleaning pads and a rib transverse to the flat surface.

An example embodiment having one or more features of the elevator sheave cleaner of any of the previous paragraphs includes a plurality of fasteners that secure the fingers to the base such that the fingers are selectively removable from the base.

The various features and advantages of an example embodiment will become apparent to those skilled in the art from the following detailed description. The drawings that accompany the detailed description can be briefly described as follows.

DETAILED DESCRIPTION

Figure 1:
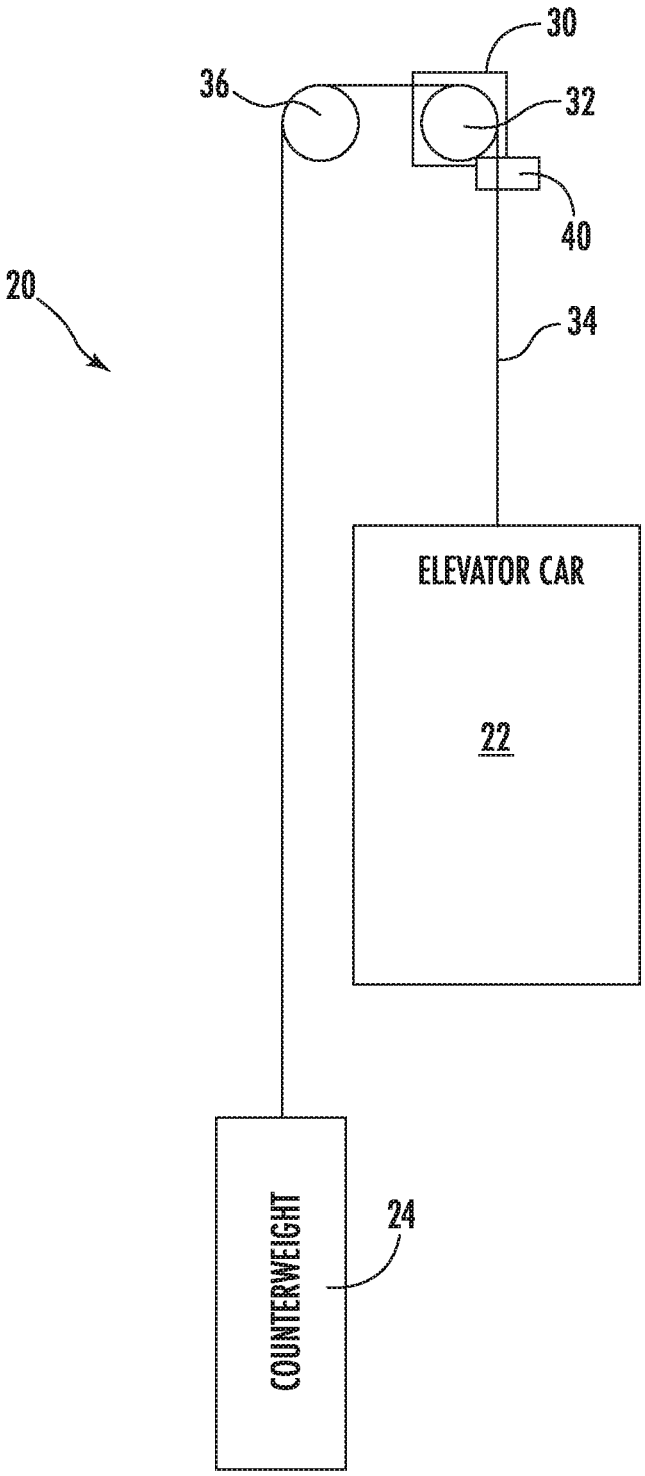
FIG. 1 schematically illustrates selected portions of an elevator system.

FIG. 1 schematically illustrates selected portions of an elevator system 20. An elevator car 22 and counterweight 24 are situated for movement within a hoistway in a known manner A machine 30 selectively causes rotation of a traction sheave 32 to cause movement of a roping assembly including a set of load bearing members 34 to achieve desired movement or positioning of the elevator car 22. The load bearing members 34 may comprise a plurality of round ropes or flat belts. At least one idler sheave 36 is included for directing the load bearing members 34 along a desired path. Those skilled in the art will understand that a variety of roping ratios are useful within different elevator systems and the number of sheaves included in such a system may vary.

Figure 2:
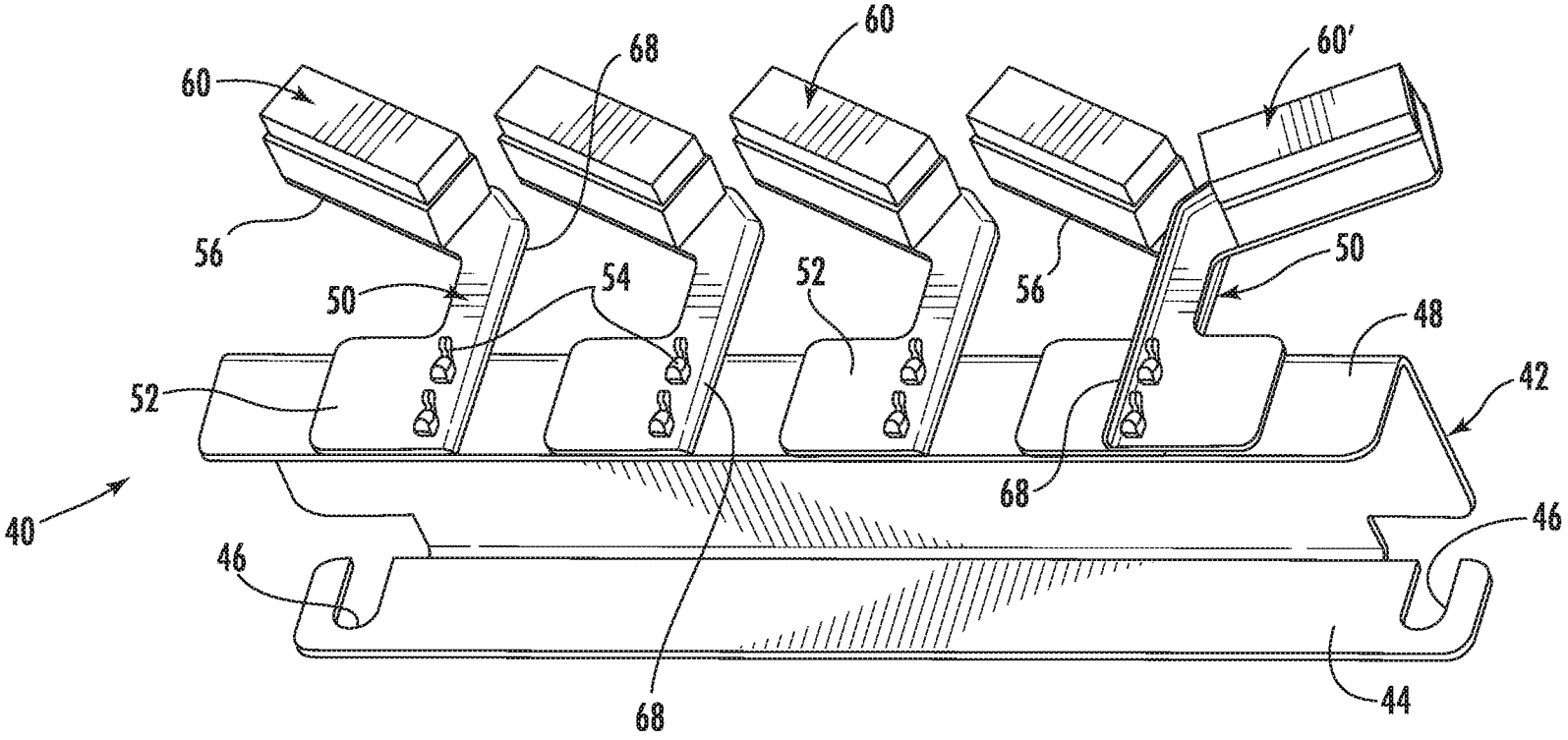
FIG. 2 is a perspective illustration of an example sheave cleaner designed according to an embodiment of this disclosure.
Figure 4:
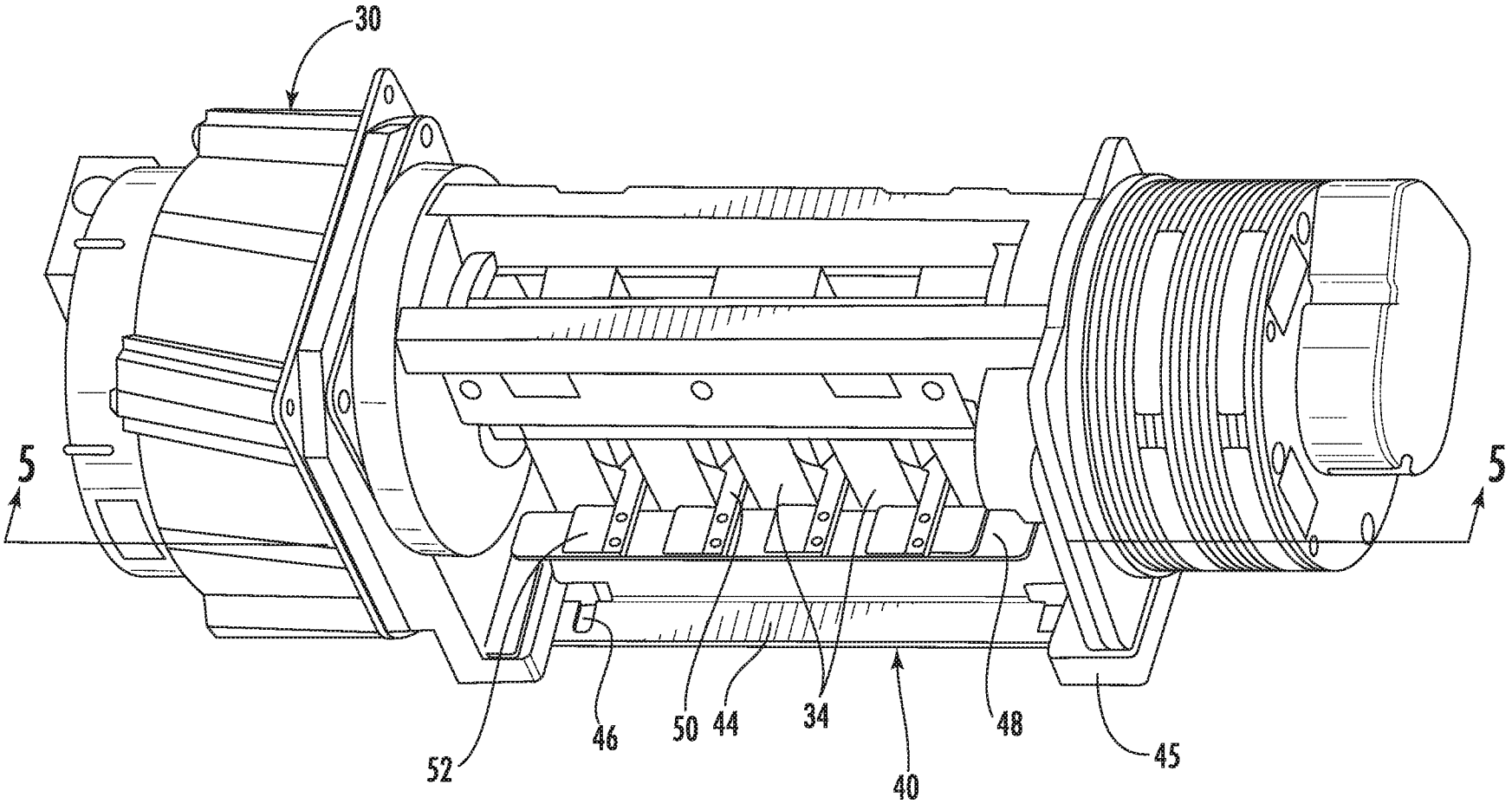
FIG. 4 shows the example embodiment of FIG. 2 situated in a position to clean an example traction sheave.

A sheave cleaner 40 is situated to clean a surface of the traction sheave 32. Maintaining a clean traction sheave surface facilitates achieving the desired traction between that sheave and the load bearing members 34, which contributes to reliable elevator system performance FIG. 2 illustrates an example embodiment of the sheave cleaner 40. This example includes a base 42 that is configured to be positioned near the traction sheave 32. The base 42 in this example includes a first portion 44 that is configured to be received adjacent to or on a portion of a machine support frame 45 as shown in FIG. 4. The first portion 44 includes slots or recesses 46 that are configured to receive at least a portion of a fastener, such as a bolt, that is used for securing the machine frame 45 in place. The same fasteners that secure the machine frame 45 in place can be used for temporarily securing the base 42 in a desired position relative to the traction sheave 32.

Figure 3:
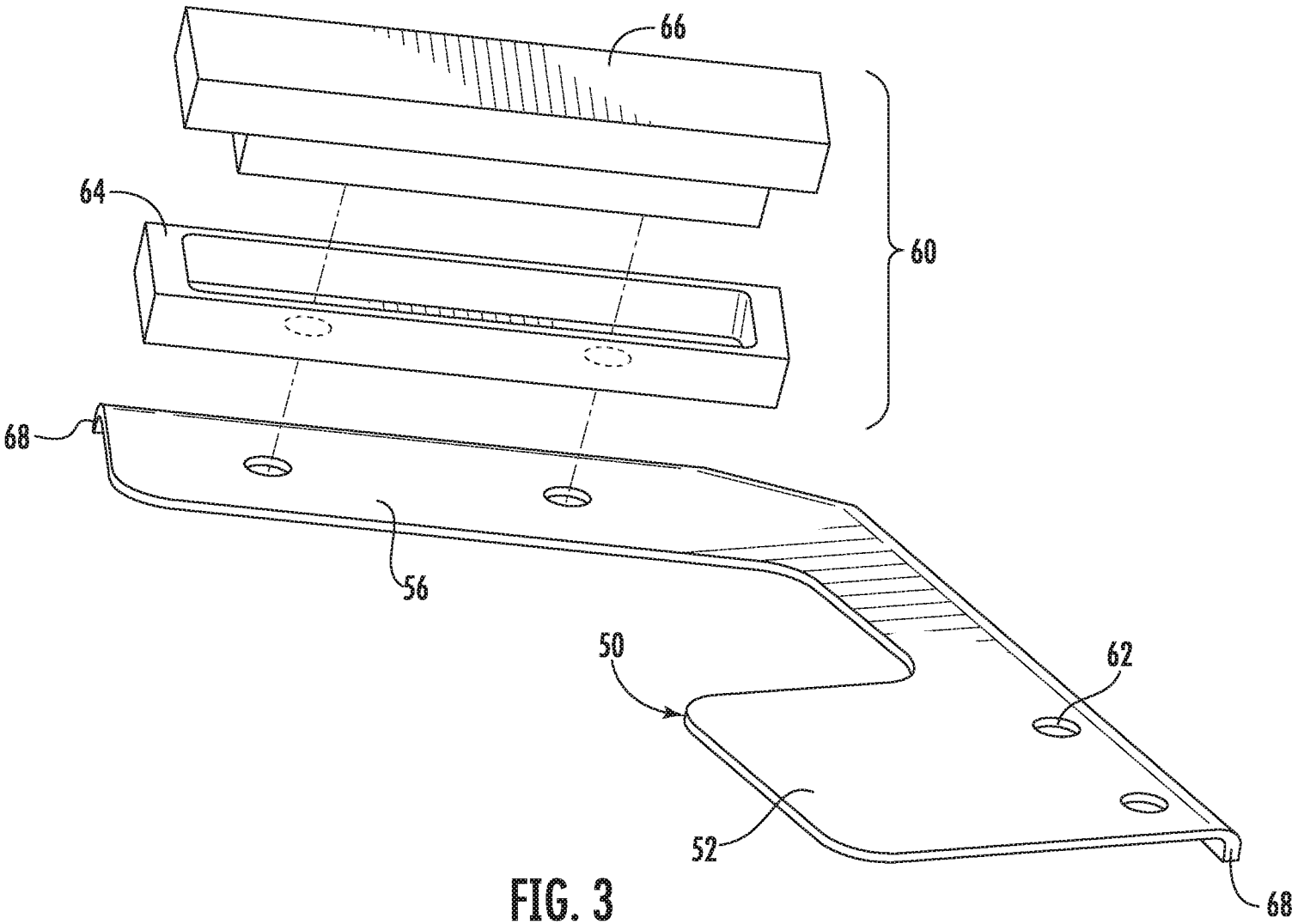
FIG. 3 illustrates selected portions of the example embodiment of FIG. 2.

The base 42 in this example includes a second portion 48 that is configured to support a plurality of fingers 50 that extend from the base 42. The fingers 50 in this example comprise metal brackets that have a first portion 52 received against and supported by the second portion 48 of the base 42. Each of the fingers 50 is held in place against the second portion 48 by fasteners 54. The illustrated embodiment includes fasteners 54 that can be selectively removed for selectively positioning a desired number of fingers 50 on the second portion 48. As shown in FIG. 3, the first portion 52 includes openings at 62 for receiving a portion of the fasteners 54 that hold the finger 50 in place against the second portion 48 of the base 42.

A second portion 56 of each finger is distal from the base 42 and oriented at an oblique angle relative to a length of the base 42.

A cleaning pad 60 is supported on each of the second portions 56 such that each finger 50 supports a cleaning pad 60. The cleaning pads 60 are oriented at the oblique angle of the second portions 56 in this example. The fasteners 54 also allow for selecting an orientation of the fingers 50 and cleaning pads 60. As can be appreciated from FIG. 2, even though all of the cleaning pads 60 are at the same oblique angle relative to the length of the base 42, at least one of the pads is at an oblique angle that is in a different direction compared to the other pads 60.

As shown in FIG. 3, the cleaning pads 60 include a rigid pad support 64 that is received against the second portion 56 of the respective finger 50. A flexible pad 66 is received at least partially within and supported by the rigid pad support 64. In the illustrated example, the flexible pad portion 66 is secured to the rigid pad mount 64 by an adhesive. The rigid pad support in this example comprises a plastic, such as polyvinylchloride, while the finger 50 comprises metal. In the illustrated example, the flexible pads 66 each comprise a sponge. In some embodiments, the sponge material includes relatively long, woven fibers that provide an effective material for cleaning the surface of a traction sheave.

As also best appreciated from FIG. 3, each finger 50 includes a generally planar body with a flat surface parallel to a cleaning surface of the respective cleaning pad 60. Each finger 50 also includes a rib 68 oriented transverse to the planar body. The rib 68 stiffens the finger 50 and provides rigidity so that the associated cleaning pad 60 is held in a stable position relative to the traction sheave 32 while a cleaning surface of the pad 60 contacts and cleans the surface of the sheave 32.

Figure 5:
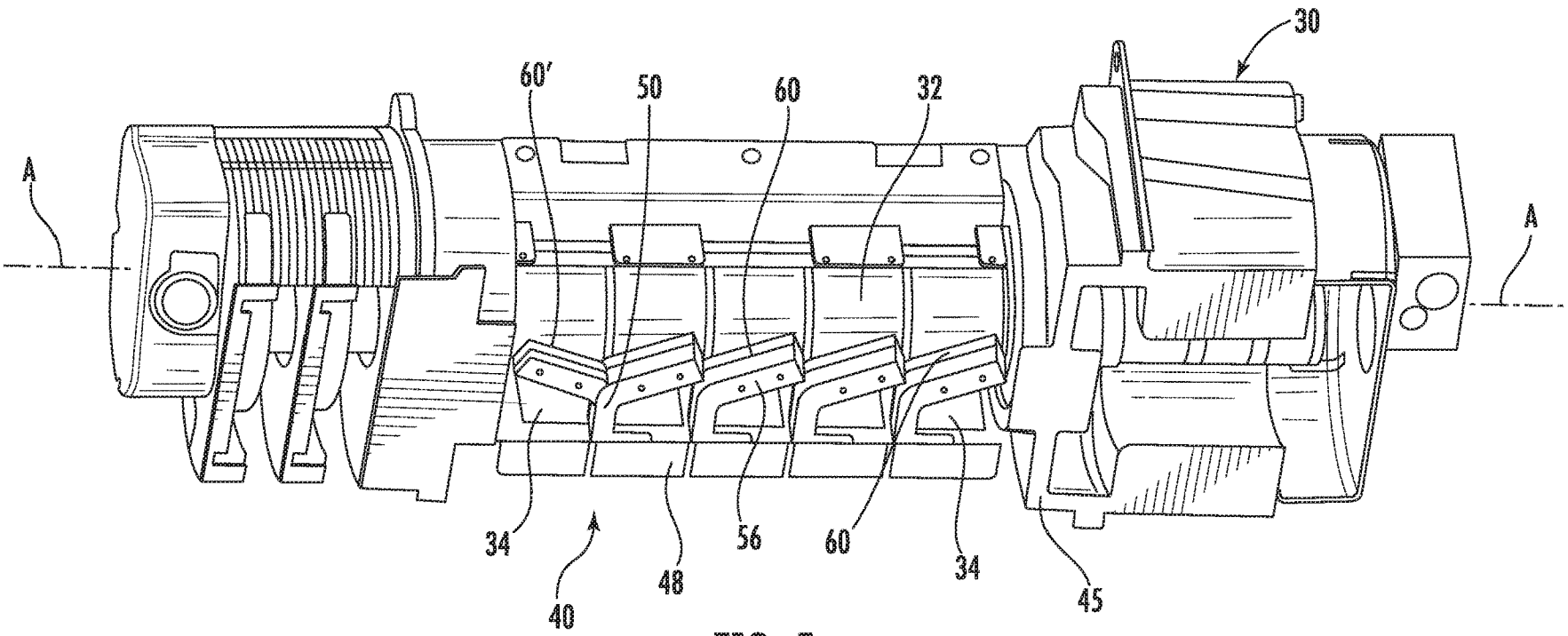
FIG. 5 is a view along the lines 5-5 in FIG. 4.

FIGS. 4 and 5 illustrate the example sheave cleaner 40 situated near the machine frame 45 and the traction sheave 32, which is not visible in FIG. 4. The base 42 is on a first side of the load bearing members 34. As can be appreciated from FIG. 5, the second portions 56 of the fingers 50 and the cleaning pads 60 are situated on a second, opposite side of the load bearing members 34. The fingers 50 are received between adjacent load bearing members 34. This configuration of the base 42 and the fingers 50 allows for the base 42 to be conveniently located on or near part of the machine frame 45 and the cleaning pads 60 to be situated where they contact the surface of the traction sheave 32 to be cleaned. The example sheave cleaner 40 provides the ability to place a cleaning pad against the surface of the traction sheave 32 without requiring a mechanic or technician to place a hand or finger directly beneath the underside of the traction sheave 32 (visible in FIG. 5) where the cleaning pads 60 engage the surface of the sheave 32.

With the cleaning pads 60 arranged at the oblique angle relative to an axis of rotation A of the traction sheave 32, the rectangular shaped flexible pads 66 are able to clean a larger surface area of the sheave 32. Moreover, the oblique angle orientation of the cleaning pads 60 facilitates inserting the second portions 56 and cleaning pads 60 into the spacings between the load bearing members 34 to manipulate the base 42 into position relative to the machine frame 45 where the sheave cleaner 40 can be temporarily secured in place.

The one cleaning pad 60' whose oblique angle is in a different direction compared to the other pads 60 may be installed onto the base 42 after the base 42 is already in position relative to the machine 30 to facilitate achieving the positons of the cleaning pads 60 shown in FIG. 5.

The angular orientation of the cleaning pads 60 also distributes the force associated with cleaning contact between the pads 60 and the surface of the traction sheave 32. The oblique angle orientation reduces a tendency for the pad 60 to be pulled in a manner that would tend to separate the flexible pad 66 from the rigid pad support 64 or the finger 50.

The illustrated example embodiment facilitates cleaning an elevator sheave in a convenient and reliable manner While the traction sheave 32 is the focus of the above description, the sheave cleaner 40 may be used to clean any sheave in an elevator system. All sections of the sheave may be cleaned simultaneously, which makes the cleaning process more efficient. Moreover, the sheave surface can be cleaned without requiring a mechanic to place a hand or finger into the spacing between the load bearing members or attempt to touch or directly access the sheave surface.

In the illustrated example, the different direction for the cleaning pad 60' is achieved by securing the cleaning pad 60' to one of the fingers 50 on an oppositely facing side of the finger compared to the others. This can be appreciated from FIG. 2 by recognizing that one of the ribs 68 faces upward in the drawing while the other ribs 68 faces downward. The second portion 48 of the base 42 in this example includes slots that receive or accommodate the ribs 68 that are facing downward (according to the drawing).

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator sheave cleaner, comprising:

a base configured to be situated on a first side of load bearing members that wrap at least partially around a sheave;

a plurality of fingers extending from the base, the fingers being configured to be received between adjacent ones of the load bearing members; and a plurality of cleaning pads, each of the cleaning pads being supported by a respective one of the fingers and spaced from the base, the cleaning pads being configured to contact and clean a surface of the sheave when the cleaning pads are on a second, opposite side of the load bearing members.

2. The elevator sheave cleaner of claim 1, wherein the fingers include a first portion oriented supported on the base and a second portion oriented at an oblique angle relative to the first portion; and each of the cleaning pads is supported on the second portion.

3. The elevator sheave cleaner of claim 2, wherein the base has a length;

the base is configured to have the length oriented parallel with an axis of rotation of the sheave; and the cleaning pads are oriented at an oblique angle relative to the axis of rotation when the cleaning pads contact the surface of the sheave.

4. The elevator sheave cleaner of claim 2, wherein each cleaning pad comprises a rigid pad support and a flexible pad; and each rigid pad support is secured to the second portion of the finger supporting the cleaning pad.

5. The elevator sheave cleaner of claim 4, wherein each flexible pad comprises a sponge.

6. The elevator sheave cleaner of claim 4, wherein the fingers comprise a first material;

the rigid pad supports comprise a second material; and the first material is different than the second material.

7. The elevator sheave cleaner of claim 2, wherein at least some of the cleaning pads are oriented at the oblique angle in a first direction;

at least one of the cleaning pads is oriented at the oblique angle in a second direction; and the first direction is different than the second direction.

8. The elevator sheave cleaner of claim 1, wherein the base comprises a first portion configured to be secured in a selected position near the sheave and a second portion that supports the fingers.

9. The elevator sheave cleaner of claim 8, wherein the first portion of the base includes a plurality of slots that are each configured to receive at least a portion of a mounting member associated with an elevator machine frame.

10. The elevator sheave cleaner of claim 1, wherein the fingers comprise a flat surface parallel with a cleaning surface on the cleaning pads and a rib transverse to the flat surface.

11. The elevator sheave cleaner of claim 1, comprising a plurality of fasteners that secure the fingers to the base such that the fingers are selectively removable from the base.

12. An elevator sheave cleaner, comprising:

a base configured to be situated near a sheave;

a plurality of fingers extending from the base, the fingers including a first portion supported on the base and a second portion oriented at an oblique angle relative to the first portion; and a plurality of cleaning pads, each of the cleaning pads being supported by a respective one of the second portions.

13. The elevator sheave cleaner of claim 12, wherein the fingers are configured to be received between adjacent load bearing members that at least partially wrap around the sheave.

14. The elevator sheave cleaner of claim 13, wherein the base is configured to be received on a first side of the load bearing members when the base is situated near the sheave; and the cleaning pads are received against a surface of the sheave on a second, opposite side of the load bearing members.

15. The elevator sheave cleaner of claim 12, wherein each cleaning pad comprises a rigid pad support and a flexible pad; and each rigid pad support is secured to the second portion of the finger supporting the cleaning pad.

16. The elevator sheave cleaner of claim 15, wherein each flexible pad comprises a sponge.

17. The elevator sheave cleaner of claim 15, wherein the fingers comprise a first material;

the rigid pad supports comprise a second material; and the first material is different than the second material.

18. The elevator sheave cleaner of claim 12, wherein at least some of the cleaning pads are oriented at the oblique angle in a first direction;

at least one of the cleaning pads is oriented at the oblique angle in a second direction; and the first direction is different than the second direction.

19. The elevator sheave cleaner of claim 12, wherein the fingers comprise a flat surface parallel with a cleaning surface on the cleaning pads and a rib transverse to the flat surface.

20. The elevator sheave cleaner of claim 12, comprising a plurality of fasteners that secure the fingers to the base such that the fingers are selectively removable from the base.

* * * * *